US007353620B1

(12) United States Patent
Houston

(10) Patent No.: US 7,353,620 B1
(45) Date of Patent: Apr. 8, 2008

(54) HAIR DRYING DEVICE

(76) Inventor: Kimberly A. Houston, 629 River St., Apt #3, Mattapan, MA (US) 02126

( * ) Notice: Subject to any disclaimer, the term of this patent is extended or adjusted under 35 U.S.C. 154(b) by 0 days.

(21) Appl. No.: 11/542,003

(22) Filed: Oct. 2, 2006

(51) Int. Cl.
*F26B 19/00* (2006.01)

(52) U.S. Cl. ..... 34/90

(58) Field of Classification Search ..... 34/90
See application file for complete search history.

(56) References Cited

U.S. PATENT DOCUMENTS

| | | | | |
|---|---|---|---|---|
| 2,738,593 | A | 3/1956 | Fox | |
| 3,058,231 | A | 10/1962 | Romiro | |
| 3,727,321 | A | 4/1973 | Waters et al. | |
| D340,094 | S | 10/1993 | Houry et al. | |
| 5,628,123 | A | 5/1997 | Chan | |
| D413,409 | S | 8/1999 | Williams | |
| 2003/0139693 | A1 | 7/2003 | Swift | |
| 2004/0127822 | A1 | 7/2004 | Eisenberg | |
| 2005/0131273 | A1 | 6/2005 | Asano et al. | |
| 2007/0157376 | A1* | 7/2007 | Paz et al. | 4/540 |

* cited by examiner

*Primary Examiner*—S. Gravini

(57) ABSTRACT

A hair drying device for supporting a person and drying hair of the person includes a chair being configured to receive a person in a seated position. The chair includes a seat portion and a pair of arm rests coupled to the seat portion. The chair includes a back portion pivotally coupled to the seat portion. The back portion supports a back of the person positioned on the seat portion. A drying assembly is coupled to the chair and in electrical communication with a power source. The drying assembly receives hair of the person when the person is reclining in the chair to dry the hair of the user. A control panel is in electrical communication with the drying assembly and the power source and coupled to the chair. The control panel controls the drying assembly when the control panel is actuated by the person.

7 Claims, 4 Drawing Sheets

HAIR DRYING DEVICE

BACKGROUND OF THE INVENTION

1. Field of the Invention

The present invention relates to salon chairs and more particularly pertains to a new salon chair for supporting a person and drying hair of the person.

2. Description of the Prior Art

The use of salon chairs is known in the prior art. The prior art commonly teaches the use of a hair care unit with a chair attached to support a person in differing positions to allow hair of the person to be cut, styled and dried.

While these devices fulfill their respective, particular objectives and requirements, the need remains for a device that has certain improved features that situates the control panel in a position to be easily accessed by a person seated on the device to control the device. Additionally, the device incorporates a massage system in a chair of the device to massage the person positioned on the chair.

SUMMARY OF THE INVENTION

The present invention meets the needs presented above by generally comprising a chair being configured to receive a person in a seated position. The chair includes a seat portion and a pair of arm rests coupled to opposite sides of the seat portion. The chair includes a back portion pivotally coupled to the seat portion. The back portion supports a back of the person positioned on the seat portion. The back portion is pivotable to a reclined position to support the person reclining in the chair. A drying assembly is coupled to the chair and in electrical communication with a power source. The drying assembly receives hair of the person when the person is reclining in the chair. The drying assembly dries the hair of the user when the drying assembly receives the hair. A control panel is in electrical communication with the drying assembly and the power source. The control panel is coupled to the chair. The control panel controls the drying assembly when the person actuates the control panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
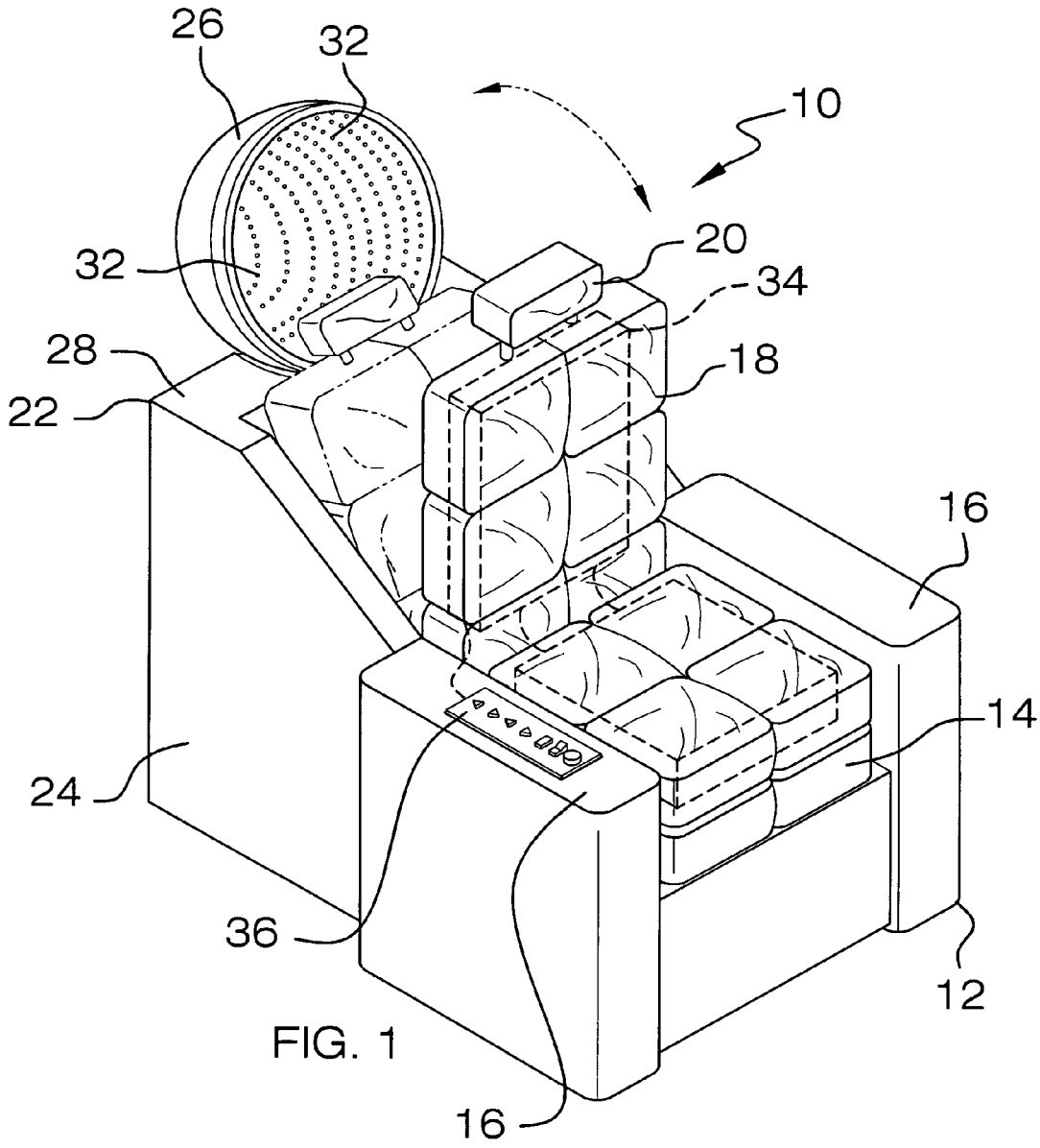
FIG. 1 is a perspective view of a hair drying device according to the present invention.
Figure 2:
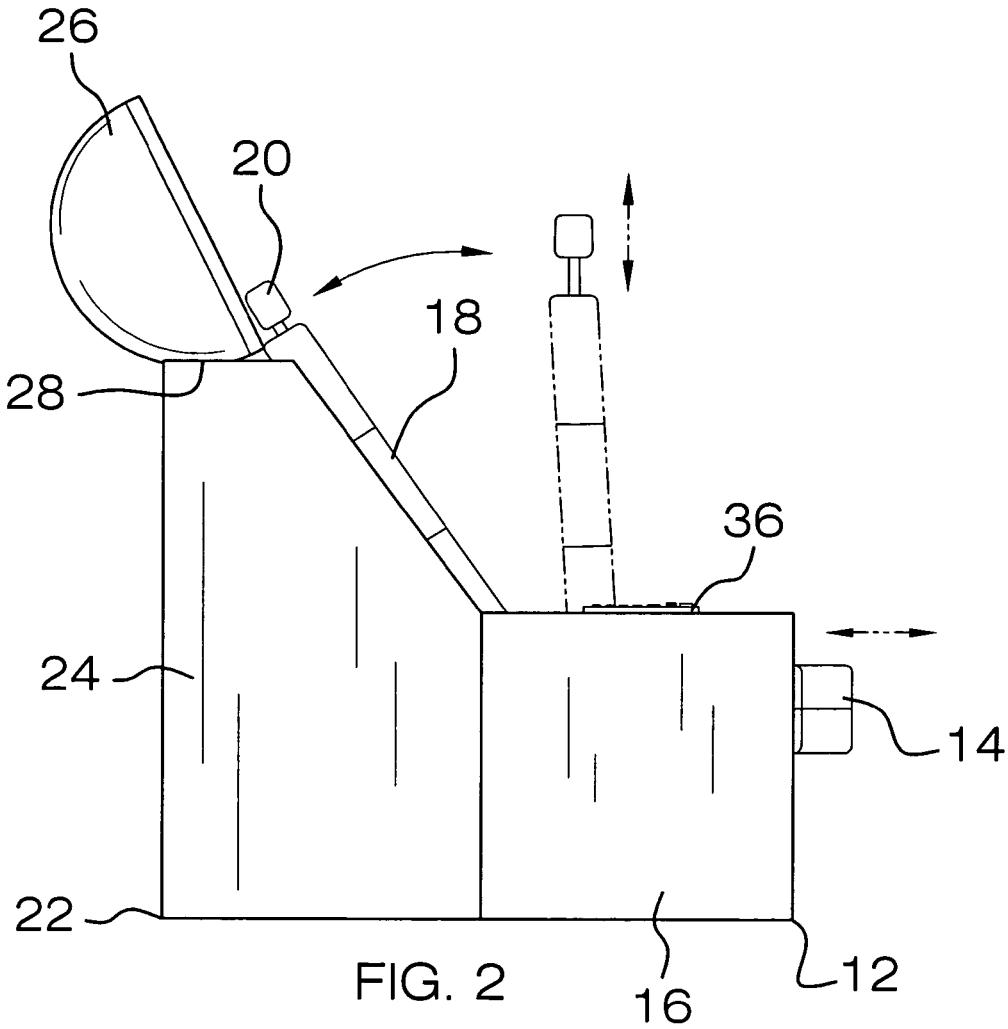
FIG. 2 is a side view of the present invention.
Figure 3:
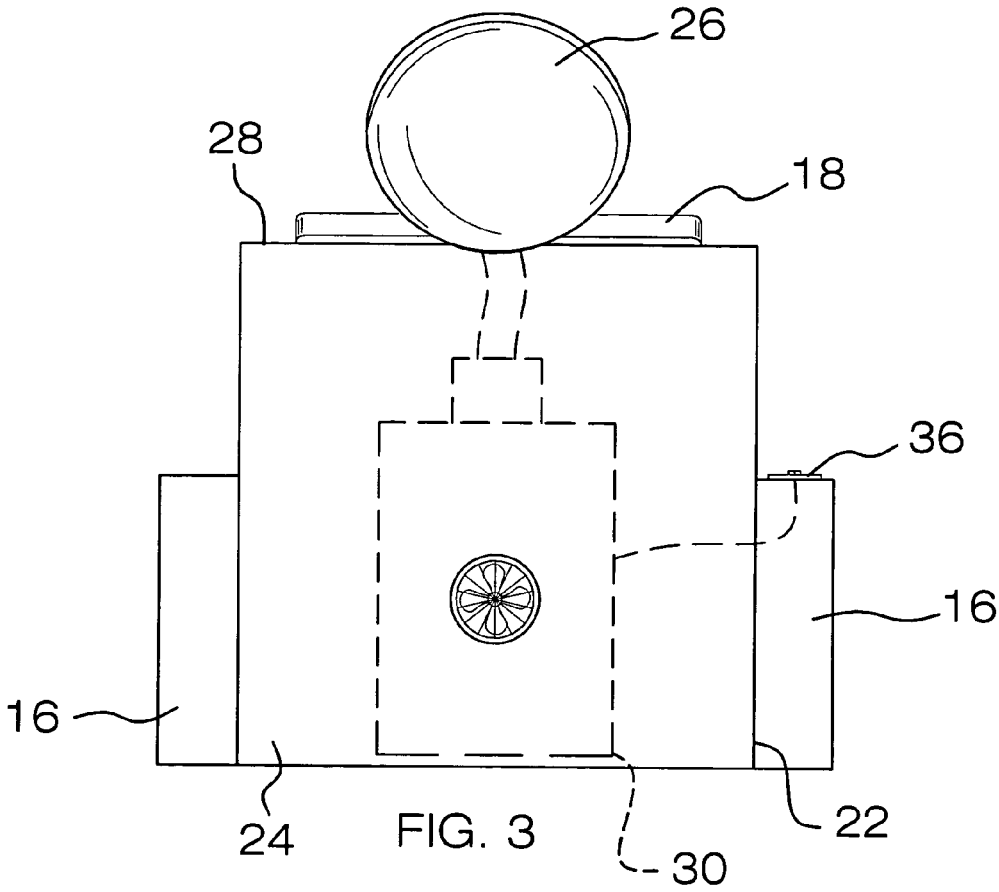
FIG. 3 is a rear view of the present invention.
Figure 4:
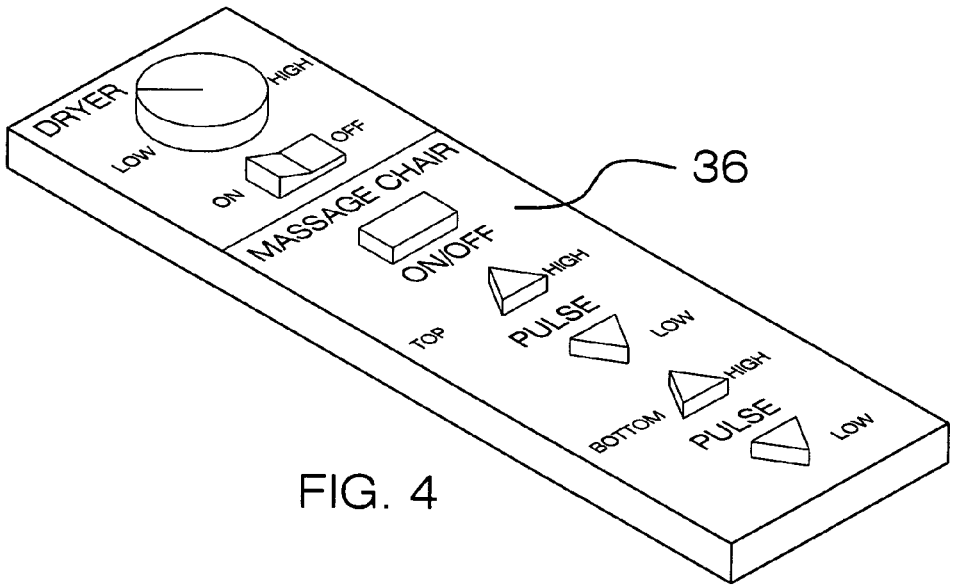
FIG. 4 is an enlarged perspective view of a control panel of the present invention.
Figure 5:
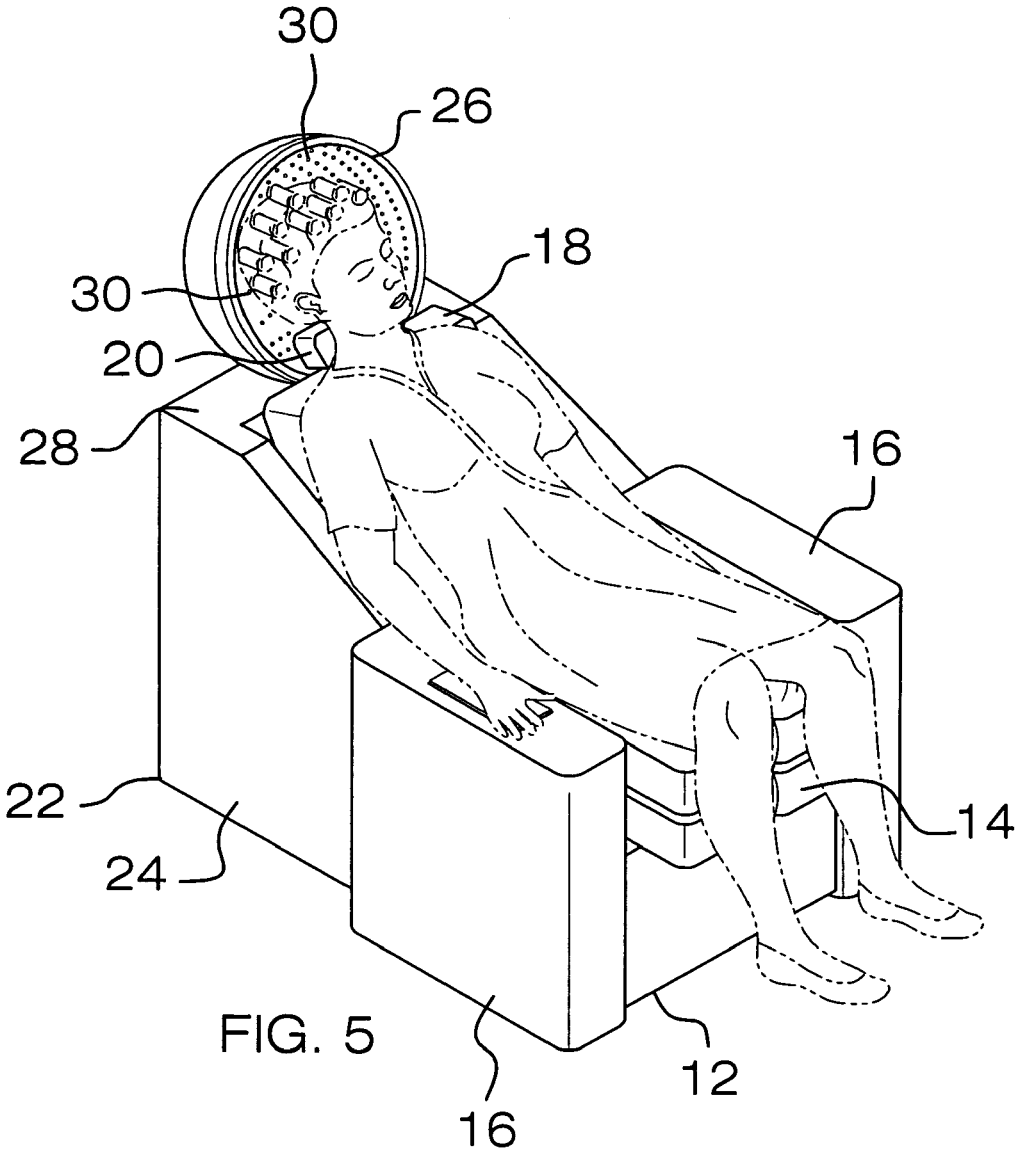
FIG. 5 is a perspective view of the present invention shown in use.

With reference now to the drawings, and in particular to FIGS. 1 through 5 thereof, a new salon chair embodying the principles and concepts of the present invention and generally designated by the reference numeral 10 will be described.

As best illustrated in FIGS. 1 through 5, the hair drying device 10 generally comprises a chair 12 being configured to receive a person in a seated position. The chair 12 includes a seat portion 14 and a pair of arm rests 16 coupled to opposite sides of the seat portion 14. The chair 12 includes a back portion 18 pivotally coupled to the seat portion 14. The back portion 18 supports a back of the person positioned on the seat portion 14. The back portion 18 is pivotable to a reclined position to support the person reclining in the chair 12. A headrest 20 is slidably coupled to the back portion 18 opposite the seat portion 14. A distance of the headrest 20 from the back portion 18 is adjustable to support a head of the person when the person is reclining in the chair 12.

A drying assembly 22 is coupled to the chair 12. The drying assembly 22 receives hair of the person when the person is reclining in the chair 12. The drying assembly 22 dries the hair of the user when the drying assembly 22 receives the hair. The drying assembly 22 includes a housing 24 coupled to and rearwardly extending from the chair 12. A hood 26 is coupled to an upper end 28 of the housing 24. The hood 26 receives a portion of the head and the hair of the person when the person is reclining in the chair 12. A blower system 30 is positioned in the housing 24 and electrically coupled to a power source. The blower system 30 is in fluid communication with the hood 26. The blower system 30 heats and forces air through a plurality of apertures 32 in the hood 26 to blow air on and dry the hair.

A massage system 34 is positioned in the back portion 18 and the seat portion 14 of the chair 12. The massage system 34 is in electrical communication with the power source. The massage system 34 massages a portion of the person positioned on the seat portion 14 and the back portion 18 to relax the person. The massage system 34 may comprise, but are not limited to, a plurality of rollers that rolled along the back and thighs of the person or a plurality of nubs that are oscillated against the back and thighs of the person.

A control panel 36 is in electrical communication with the blower system 30, the massage system 34 and the power source. The control panel 36 is positioned on the arm rest 16 of the chair 12 to be accessed by the person positioned on the chair 12. The control panel 36 controls the blower system 30 and the massage system 34 when the person actuates the control panel 36.

In use, the person sits on the seat portion 14 of the chair 12 and leans against the back portion 18 of the chair 12. The back portion 18 is pivoted back to allow the person to be positioned in a reclined position and position the head and hair of the person in the hood 26. The control panel 36 is actuated to activate the blower system 30 of the dryer assembly and blow air on the hair to dry the air. Additionally, the control panel 34 may be actuated to actuate the massage system 34 and massage the back and thighs of the person positioned on the chair 12 while the hair is drying.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair drying device for drying hair of a person, said device comprising:

a chair being configured to receive the person in a seated position, said chair including a seat portion and a pair of arm rests being coupled to opposite sides of said seat portion, said chair including a back portion being pivotally coupled to said seat portion, said back portion supporting a back of the person positioned on said seat portion, said back portion being pivotable to a reclined position to support the person reclining in said chair;

a drying assembly being coupled to said chair and in electrical communication with a power source, said drying assembly receiving the hair of the person when the person is reclining in said chair, said drying assembly drying the hair of the user when the drying assembly receives the hair;

a control panel being in electrical communication with said drying assembly and the power source, said control panel being coupled to said chair, said control panel controlling said drying assembly when said control panel is actuated by the person; and a massage system being positioned in said back portion and said seat portion of said chair, said massage system being in electrical communication with the power source, said massage system massaging a portion of the person positioned on said seat portion and said back portion to relax the person, said massage system being in electrical communication with said control panel, wherein said control panel controls said massage system when said control panel is actuated.

2. The device according to claim 1, wherein said chair includes a headrest being slidably coupled to said back portion opposite said seat portion, a distance of said headrest from said back portion being adjustable to support a head of the person when the person is reclining in said chair.

3. The device according to claim 1, wherein said drying assembly includes a housing being coupled to and rearwardly extending from said chair.

4. The device according to claim 3, wherein said drying assembly includes a hood being coupled to an upper end of said housing, said hood receiving the portion of the head and the hair of the person when the person is reclining in said chair.

5. The device according to claim 4, wherein said drying assembly includes a blower system being positioned in said housing and electrically coupled to the power source, said blower system being in fluid communication with said hood, said blower system heating and forcing air through a plurality of apertures in said hood to blow air on and dry the hair.

6. The device according to claim 1, wherein said control panel is positioned on said arm rest of said chair to be accessed by the person positioned on said chair.

7. A hair drying device for drying hair of a person, said device comprising:

a chair being configured to receive the person in a seated position, said chair including a seat portion and a pair of arm rests being coupled to opposite sides of said seat portion, said chair including a back portion being pivotally coupled to said seat portion, said back portion supporting a back of the person positioned on said seat portion, said back portion being pivotable to a reclined position to support the person reclining in said chair, a headrest being slidably coupled to said back portion opposite said seat portion, a distance of said headrest from said back portion being adjustable to support a head of the person when the person is reclining in said chair;

a drying assembly being coupled to said chair, said drying assembly receiving the hair of the person when the person is reclining in said chair, said drying assembly drying the hair of the user when the drying assembly receives the hair, said drying assembly comprising:

a housing being coupled to and rearwardly extending from said chair;

a hood being coupled to an upper end of said housing, said hood receiving the portion of the head and the hair of the person when the person is reclining in said chair;

a blower system being positioned in said housing and electrically coupled to a power source, said blower system being in fluid communication with said hood, said blower system heating and forcing air through a plurality of apertures in said hood to blow air on and dry the hair;

a massage system being positioned in said back portion and said seat portion of said chair, said massage system being in electrical communication with the power source, said massage system massaging a portion of the person positioned on said seat portion and said back portion to relax the person; and a control panel being in electrical communication with said blower system, said massage system and the power source, said control panel being positioned on said arm rest of said chair to be accessed by the person positioned on said chair, said control panel controlling said blower system and said massage system when said control panel is actuated by the person.

* * * * *